United States Patent [19]

Franckowiak et al.

[11] Patent Number: 5,021,143

[45] Date of Patent: Jun. 4, 1991

[54] PROCESS OF FRACTIONATION AND EXTRACTION OF HYDROCARBONS ALLOWING OBTAINING A CUT OF INCREASED OCTANE INDEX AND A KEROSENE OF IMPROVED SMOKE POINT

[75] Inventors: Sigismond Franckowiak, Rueil-Malmaison; Paul Mikitenko, Noisy Le Roi; Pierre Baumgartner, Lyon; Georges Cohen, Aigremont, all of France

[73] Assignee: Institut Francais du Petrole, Rueil Malmaison, France

[21] Appl. No.: 388,033

[22] Filed: Aug. 2, 1989

[30] Foreign Application Priority Data

Aug. 2, 1988 [FR] France ..... 88 10545

[51] Int. Cl.[5] ..... C10G 57/00

[52] U.S. Cl. ..... 208/70; 208/87; 208/92; 208/93; 208/96; 208/100; 208/177; 208/315; 208/317; 208/318; 208/330; 208/332; 208/333

[58] Field of Search ..... 208/67, 69, 70, 92, 208/93, 95, 96, 100, 177, 311, 315, 317, 318, 322, 332, 333, 330, 87

[56] References Cited

U.S. PATENT DOCUMENTS 3,793,192 2/1974 Gladrow et al. ..... 208/93
4,209,383 6/1980 Herout et al. ..... 208/93

OTHER PUBLICATIONS

Sowelch, G. S., "How to Improve Aromatics Extraction", 10/1963, pp. 157-163, *Hydrocarbon Processing & Petroleum Refiner.*

*Primary Examiner*—Curtis R. Davis
*Assistant Examiner*—Nhat Phan
*Attorney, Agent, or Firm*—Millen, White & Zelano

[57] ABSTRACT

The invention relates to a process for hydrocarbon fractionation and extraction making it possible to obtain a petrol with an improved octane number and a kerosene with an improved smoke point.

According to the invention a charge with a final boiling point of at least 220° C. is fractionated into three fractions:

a light petrol containing less than 10% aromatics and boiling points at 25° to 80° C., a medium petrol (80° C. and at the most 150° C.), whose end point is determined by a nitrogen content below 50 ppm, a heavy petrol with an end point equal to or below 220° C., be a selective liquid solvent aromatics are then extracted from the heavy petrol producing a refined product which is poured into the kerosene pool or diesel fuel, the solvent is regenerated by reextraction using light petrol so as to produce an aromatics-enriched petrol fraction with an improved octane number.

13 Claims, 1 Drawing Sheet

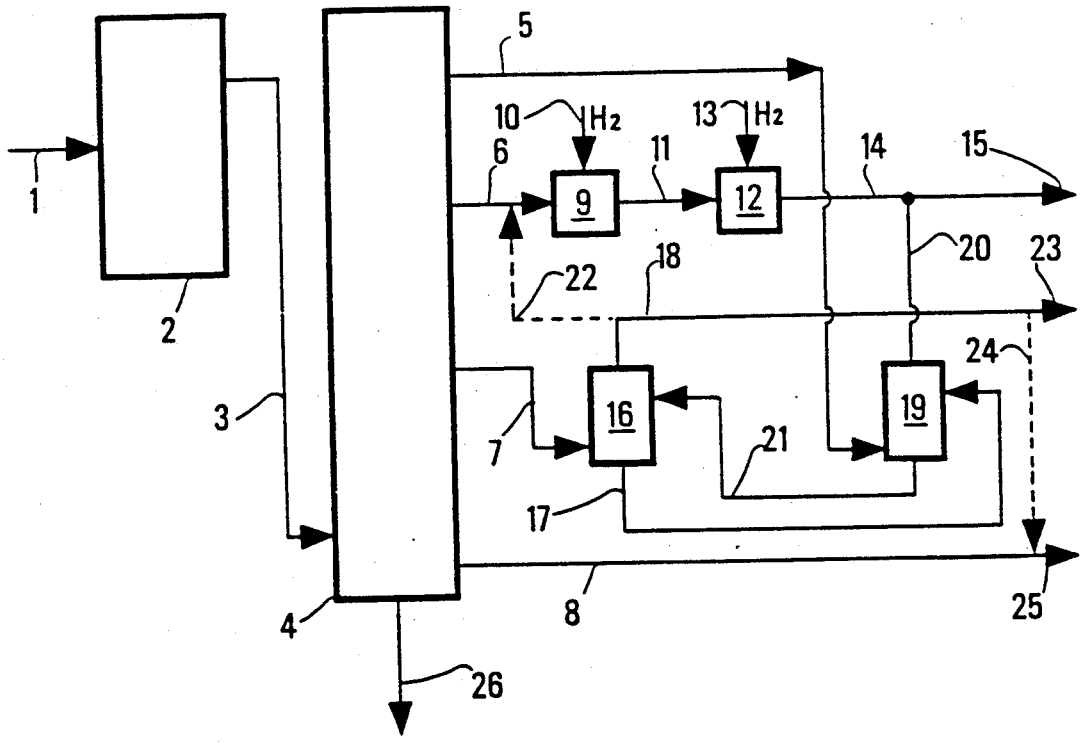
1
2
3
4
5
6
7
8
9
10
H2
11
12
13
H2
14
15
16
17
18
19
20
21
22
23
24
25
26

PROCESS OF FRACTIONATION AND EXTRACTION OF HYDROCARBONS ALLOWING OBTAINING A CUT OF INCREASED OCTANE INDEX AND A KEROSENE OF IMPROVED SMOKE POINT

BACKGROUND OF THE INVENTION

The invention relates to a process for the fractionation and extraction of hydrocarbons and in particular a process for the production of petrol with an improved octane number and kerosene with an improved smoke point and optionally a process for the production of diesel or gas oil with an improved cetane number by the selective extraction of appropriate hydrocarbon fractions.

It is known to produce petrol through atmospheric distillation of a hydrocarbon charge. The liquid effluents distilling between approximately 50° and 130° C. constitute a petrol fraction or cut with a relatively low octane number due to the preponderance of saturated hydrocarbons and to said fraction can be added at least part of a heavy petrol fraction at 130° to 220° C., which is richer in aromatic hydrocarbons and of interest due to its high octane number. This solution is totally adopted in summer, part of the heavy petrol being used for aviation fuel. However, in winter, most of the heavy petrol is mixed with the diesel oil fraction to meet heating requirements.

It is also known to improve the octane number of the petrol fraction by reforming, cf. U.S. Pat. No. 3,044,950, but the nitrogen content of the charge must not exceed 50 ppm, which makes it impossible to directly treat the heavy petrol fractions of 130° to 220° C., which are richer in nitrogen and in particular heavy catalytic cracking petrols.

In order to obviate this disadvantage, it is necessary to pretreat using a severe hydrotreatment said heavy petrol fraction, said pretreatment being difficult and expensive.

Moreover, French Patent No. 1,421,273 discloses a process for the extraction of hydrocarbons (e.g. benzene, toluene and xylene and/or polycyclic aromatic hydrocarbons) using an extraction solvent, such as dimethylsulfoxide, in a first extraction zone. However, its use has come up against numerous difficulties due to its mediocre stability with respect to heat and distillation treatments. In order to avoid distillation during the separation of the mixture incorporating the extract enriched with aromatic hydrocarbons and dimethylsulfoxide, it is advantageous to use an auxiliary solvent in a second extraction zone, which is able to dissolve the hydrocarbons of the charge, but unable to dissolve a substantial quantity (more than 5% of its weight) of dimethylsulfoxide. The latter can consequently be separated and then recycled into the first extraction zone.

In order to recover this extracted and substantially purified aromatic fraction, it is necessary to carry out a number of operations such as washing with water in order to remove the dimethylsulphoxide traces, followed by a distillation of the remaining mixture, i.e. the aromatic hydrocarbons and auxiliary solvent, which is thus separated and then recycled into the second extraction zone.

Moreover, French Patent No. 1,424,225 teaches the extraction of aromatic and non-aromatic constituents of light cycle oil (L.C.O.) constituted by a distillation fraction of approximately 204° to 316° C. produced by catalytic cracking of the petroleum in two successive zones. In the first, use is made of a mixture of dimethylformamide and approximately e.g. 10% water as the solvent for the aromatics, while in the second, use is made of a mixture of saturated hydrocarbon-rich naphtha and xylene in order to extract a mixture containing the aromatic hydrocarbons and recycle the solvent to the first extraction zone.

The thus extracted mixture is then passed into a distillation column. At the bottom or tail an aromatic hydrocarbon concentrate is collected and at the head at least part of the naphtha is collected which is then recycled into the second extraction zone. This operation is expensive from the energy standpoint.

The prior art is finally illustrated by U.S. Pat. No. 3,044,950, which describes a double treatment of a 25°-220° C. charge combining a hydrotreatment, followed by an extraction by solvent. This hydrotreatment is performed on the entire charge, or on the heaviest fraction of the charge obtained by distillation.

The hydrogenation of the lightest fraction of the charge leads to an octane number reduction and the hydrogenation of the heaviest fraction can only be carried out under very severe pressure conditions in view of the large nitrogen quantity in said fraction. Moreover, the hydrogenation of the heaviest fraction and consequently the aromatic hydrocarbons contained therein leads to a reduction in its octane number.

SUMMARY OF THE INVENTION

One of the objects of the invention is consequently to obviate the aforementioned disadvantages.

It has been found that it was not necessary to redistill the so-called auxiliary solvent added in the second extraction stage of French Patent No. 1,424,225. A process for the fractionation and extraction of hydrocarbons making it possible to obtain significantly better results in the prior art has also been discovered and this is another object of the invention.

More specifically, the invention relates to a process for the fractionation and extraction of hydrocarbons making it possible to obtain from a hydrocarbon charge a petrol with an improved octane number and a kerosene with an improved smoke point, whose end boiling point is at least 220° C. and preferably between 25° and 350° C. The process comprises:

(a) a stage of fractionating said charge under fractionation conditions supplying at least three fractions:

1. A light petrol fraction with a boiling point between approximately 25° C. and approximately 80° C. and containing approximately less than 10% by weight of aromatic hydrocarbons,
2. A medium petrol fraction with a boiling point between approx 80° C. and at the most approximately 150° C. having a nitrogen content below approximately 50 ppm,
3. A heavy petrol fraction with a final boiling point at the most equal to approximately 220° C. and e.g. boiling points between approximately 150° C. and at the most 220° C., having an aromatic hydrocarbon content generally between 25 and 75% by weight, (b) A stage of extracting most of the aromatic hydrocarbons of said heavy petrol fraction under extraction conditions by a first solvent of the aromatic hydrocarbons, in a first extraction zone producing a dearomatized refined product and a mixture incorporating said solvent and an extract enriched with said aromatic hydrocarbons, the volume ratio between the first solvent and the heavy petrol fraction being between 1 and 3, (c) A stage of extracting said mixture by a second auxiliary solvent under extraction conditions in a second extraction zone, producing on the one hand said extract incorporating said second auxiliary solvent and on the other hand said first solvent which is recycled to stage (b), the volume ratio of the auxiliary solvent to the said mixture being between 0.5 and 2.

The process is characterized in that said auxiliary solvent is the light petrol fraction (approximately 25° C. to approximately 80° C.) and in that:

(d) At least part of the dearomatized refined product of stage (b) is collected, so as to obtain a kerosene with an improved smoke point.

Through the use of a light petrol fraction of 25° to 80° C. as the auxiliary reextraction solvent of the first solvent of the aromatic hydrocarbons, the inventive process has the advantage of avoiding a distillation, which saves energy. Moreover, the production of said light fraction is accompanied by an increase in the quality of the petrol obtained and simultaneously leads to an improvement in the kerosene quality.

The initial hydrocarbon charge used is a hydrocarbon charge, whose final boiling point is at least 220° C. and which is e.g. between its initial boiling point and a final boiling point of 600° C., e.g. 25° to 350° C. This charge can be obtained from a catalytic cracking, thermal cracking or hydrocracking process. It can also be a crude petroleum charge or a distillate containing at least petrol and kerosene fractions and which has not undergone the aforementioned treatments. Preference is given to the use of an effluent from a fluid catalytic cracking unit (F.C.C.) and whose starting charge was cracked in the presence of a catalyst under known cracking conditions. This effluent enriched in this way with olefinic hydrocarbons will help to bring about an improvement to the octane number of the light petrol fraction.

The starting charge or aforementioned effluent, referred to as "charge" hereinafter, is fractionated by distillation using conventional known means.

The fractions obtained can, as a function of the number of distillation column trays, have partly overlapping boiling point ranges.

In this distillation zone, the lightest gases can be separately collected, as well as the water and hydrogen sulfide.

The light petrol fraction generally contains less than 10% and preferably 0.1 to 5% by weight of aromatic hydrocarbons.

The medium petrol fraction generally has a nitrogen content below approximately 50 ppm (1 ppm=part per million), e.g. between 5 and 50 and preferably between 20 and 40 ppm and this content determines the final boiling point of said fraction.

Finally, the heavy petrol fraction contains in general 25 to 75% by weight of aromatic hydrocarbons and generally approximately less than 15 and preferably 1 to 10% by weight approximately of dicyclic hydrocarbons having at least one aromatic ring.

It is advantageously possible to reform the medium petrol fraction following a hydrotreatment normally making it possible to lower the nitrogen content to less than 1 ppm prior to mixing it with the extract and auxiliary solvent of stage (c), which makes it possible to further improve the octane number of the resulting mixture.

According to an embodiment of the process, the fractionation of the charge can lead to the appearance of a fraction with a boiling point above 220° C. for supplying diesel motor oil. This fraction can be a light cycle oil fraction, if the charge results from catalytic cracking. At least part of the refined product of stage (b) according to the process of the invention can be mixed with at least part of the above fraction to supply diesel motor oil.

It is also possible with this part of the refined product of stage (b) according to the invention to directly supply the diesel motor oil storage pool, so as to improve its cetane number.

According to another embodiment of the process, the medium petrol fraction of stage (a) conventionally containing 5 to 50 ppm of nitrogen is hydrotreated in the presence of hydrogen in a hydrotreatment zone. The hydrotreatment conditions are such that the residual nitrogen quantity is below 1 ppm. The collected hydrotreatment effluent then undergoes catalytic reforming in the presence of hydrogen in a reforming zone under reforming conditions such as to obtain a medium petrol fraction with an improved octane number.

This medium petrol fraction can be at least partly and preferably totally mixed with the aromatic extract, which is itself mixed with the 25° to 80° C. fraction according to stage (c) of the process and this gives a petrol with a better octane number than that according to stage (c) of the process.

According to another particularly advantageous embodiment of the process, it is possible to mix at least part of the refined product, e.g. 5 to 80% and preferably 10 to 20% by weight with the medium 80° to 150° C. petrol fraction, in a proportion such that the nitrogen quantity of the thus obtained mixture remains below 50 ppm (1 ppm=1 part per million). The said mixture then undergoes hydrotreatment under hydrotreatment conditions such that the nitrogen quantity does not exceed 1 ppm. The hydrotreatment effluent then undergoes catalytic reforming in the presence of hydrogen in a reforming zone, in accordance with operating conditions such that a reformed petrol with an improved octane number is obtained. The thus obtained reformed petrol can then be mixed at least partly and preferably totally with at least part and preferably all the extract incorporating the light 25° to 80° C. petrol fraction produced according to stage (c) of the process.

Thus, compared with the prior art (U.S. Pat. No. 3,044,950), prior to reforming hydrotreatment only takes place with the refined product of the aromatics-depleted heaviest fraction, as opposed to all of the heaviest fraction, which makes it unnecessary to operate under very severe hydrotreatment and reforming conditions.

The hydrotreatment operation (hydrodesulfurization and hydrodenitrogenization) is carried out under conditions such that in general there is only a sulphur and nitrogen quantity below 10 ppm and preferably below 1 ppm. The operation is a function of the type of charge. These conditions are known to the Expert and are e.g. described in U.S. Pat. No. 3,044,950 and are generally as follows:

Temperature: 300° to 350° C.
Pressure: 20 to 30 bar
$H_2$/charge: 30 to 80 by volume
VVH: 2–10

Catalyst: alumina +CO−MO (procatalysis)

The reforming conditions are described in U.S. Pat. Nos. 3,044,950, 3,627,671, 4,172,027, 4,133,733, 4,210,519 and 4,233,288 and are generally as follows:

Temperature: at intake 480° to 520° C.

Pressure: 3.5 to 10 bar $H_2$/charge: 2–6 (mode)

V.V.H.: 1.5–3

Catalyst: alumina+(Pt+Sn) or (Pt+Re) (procatalysis)

The extraction solvents of the aromatic hydrocarbons of the heavy petrol fraction can be those described in U.S. Pat. No. 3,627,671 and are preferably dimethylsulfoxide, polyethylene glycol and dimethyl formamide. These solvents can advantageously contain water, e.g. 0.1 to 20% and preferably 1 to 10% by weight in order to bring about an optimum adjustment of the separation selectivity.

The auxiliary solvent, in the present case the 25° to 80° C. fraction, used for separating the first extraction solvent in the second extraction zone can contain, particularly when the starting charge has been catalytically cracked, an olefin quantity between 20 and 60%, which will help to improve the octane number of the petrol intended for the petrol pool.

It is possible for performing the present process to use all liquid-liquid and preferably countercurrent extraction apparatuses, e.g. filling columns with trays or mechanical stirring (R.D.C.: rotating disc contactor) having in general 3 to 20 and preferably 5 to 10 stages at a temperature generally between 20° and 120° C. and advantageously between 60° and 80° C. and under a pressure making it possible to operate in the liquid phase and therefore between 1 and 10 and preferably 1 and 3 bar. The solvent to heavy petrol fraction volume ratio is generally between 1 and 3 and preferably between 1.5 and 2 in the first extraction unit. In the second extraction unit, the volume ratio between the light petrol fraction and the charge introduced, i.e. the mixture incorporating the first extraction solvent and the aromatic hydrocarbon-enriched extract is generally between 0.5 and 2, preferably between 1 and 1.5.

The motor and research octane numbers are determined according to ASTM Standards D2699-D2700, while the smoke point and cetane number are determined according to ASTM Standards D13 22 and D613.

BRIEF DESCRIPTION OF THE DRAWING

The invention will be better understood from the single drawing illustrating the process.

DESCRIPTION OF THE DRAWING

An e.g. vacuum distillate with boiling points between approximately 350° and 550° C. is introduced by a line 1 into a catalytic cracking unit 2, where it is cracked under cracking conditions in the presence of a catalyst.

The liquid catalytic cracking effluent or charge according to the invention, e.g. of 25° to 550° C., following the separation of the catalyst is introduced by a line 3 into the base of a distillation unit 4, where it is fractionated. At the head is collected a light petrol fraction of approximately 25° to 80° C. (which, as will be seen hereinafter, is fed to the base of a second extraction unit 19 (and a medium petrol fraction with boiling points between approximately 80° and 150° C. and which is supplied by a line 6 to a petrol storage pool 15. This medium petrol can be reformed in a reforming unit 12 in the presence of hydrogen supplied by a line 13 and a reforming catalyst. However, it may prove necessary to pretreat the petrol in such a way that, prior to reforming, said fraction does not have a nitrogen quantity exceeding 1 ppm and a sulfur quantity exceeding 1 ppm. This pretreatment is carried out in a hydrotreatment unit 9 upstream of the reforming unit 12 and in the presence of hydrogen supplied by a line 10 and a hydrotreatment catalyst. The conditions are such that it is possible to obtain the indicated nitrogen and sulfur quantities. The hydrotreatment effluent is then supplied by a line 11 to the reforming unit.

From the fractionation unit 4 is also collected a heavy petrol fraction with a boiling point between approximately 150° and 220° C., which is supplied by a line 7 to a first extraction unit 16 supplied with an aromatic hydrocarbon extraction solvent, e.g. dimethylsulfoxide. The refined fraction enriched with non-aromatic hydrocarbons or refined product is collected at least partly in the upper part of the unit, washed to eliminate extraction solvent traces (device not shown in the drawing) and supplies via line 18 the kerosene storage pool. This fraction has an improved smoke point. Part of this same refined fraction can supply by a line 22, the line 6 for supplying the medium petrol fraction upstream of the hydrotreatment unit 9 and reforming unit 12. The refined product quantity mixed in this way with the medium petrol fraction is such that the thus obtained mixture has a nitrogen quantity below 50 ppm and can thus be hydrotreated in conventional manner and then subject to a reforming process, as indicated hereinbefore, for increasing its octane number. The hydrotreatment carried out on this mixture makes it possible, as stated hereinbefore, to lower the sulphur and nitrogen contents to approximately at the most 1 ppm and also hydrogenates at least part of the olefins of said mixture, which can be a poison for the reforming catalyst.

The extracted fraction enriched in aromatic hydrocarbons and mixed with the first extraction solvent is drawn off by line 17 and then supplied by the latter to the top of a second extraction unit 19. At the base of said unit is introduced in countercurrent manner a light petrol fraction of 25° to 80° C. (second auxiliary solvent). This light petrol can dissolve the aromatic hydrocarbons but is unable to dissolve a substantial quantity of the first extraction solvent, i.e. it is unable to dissolve more than 5% and preferably more than 1% of the weight of said solvent. The first extraction solvent is collected at the base of unit 19 and recycled by a line 21 to the top of the first extraction unit 16. The second extraction effluent with an improved octane number and mixed with the light petrol fraction is in turn supplied to the petrol storage pool 15 by a line 20, following the removal of traces of the first extraction solvent using conventional means not shown in the drawing.

When the distillation charge, e.g. from the catalytic cracking unit 2, contains a fraction with a boiling point above 220° C. and liable to constitute a light cycle oil fraction for supplying by a pipe 8 a diesel motor oil storage pool 25, it is possible to improve its cetane number by mixing with said L.C.O. fraction at least part (e.g. 80%) of the refined product of the heavy petrol fraction from the first extraction unit 16 by means of a line 24.

Finally, the distillation residue (350° C.+) is collected at the bottom of distillation unit 4 by pipe 26.

EXAMPLES

The following example illustrates in a non-limitative manner the process according to the invention.

Example 1

A Brent vacuum distillate with a boiling point between approximately 350° and 550° C. is introduced into a catalytic cracking unit operating under the following conditions in the presence of a zeolite Y-based catalytic cracking catalyst (Octacat®):

Contact time: 2–3s

Catalyst to charge weight ratio: 6

Riser temperature: 520° C.

Regenerator temperature: 750° C.

Conversion (% by weight): 77%

The liquid catalytic cracking effluent undergoes distillation supplying at least four fractions (Table I) $E_1$, $E_m$, $E_L$ and L.C.O.

TABLE I

| Fraction | % by weight relative to charge | % aromatics | ppm N | Research octane number (RON) | Motor octane number (MON) |
|---|---|---|---|---|---|
| $E_1$ 25–80° C. | 15 | 33 | / | 95 | / |
| $E_m$ 80–150° C. | 15 | 33 | 20 | 89 | / |
| $E_L$ 150–220° C. | 15 | 65* | 130 | 82 | 15 |
| L.C.O. 220–350° C. | 25 | | | / | 25 |

*7% dicyclic aromatics with at least one aromatic nucleus.

The extraction of the heavy petrol fraction takes place in a six stage R.D.C.-type extraction unit in countercurrent manner in the presence of dimethylsulfoxide containing 2% water, at a temperature of approximately 70° C. and a pressure substantially equal to 2 bar, so as to keep the mixture in the liquid phase.

The solvent to charge ratio is approximately 1.6 by volume. The refined product is washed with water, in such a way that the solvent quantity does not exceed 5 ppm and supplies the kerosene or diesel oil reservoir or pool.

The extract mixed with the dimethylsulfoxide is extracted in countercurrent manner by the light petrol fraction in a second extraction unit of the same type as the first at a pressure substantially equal to 2 bar and a temperature of approximately 70° C.

The solvent (light petrol fraction) to charge ratio in the second unit is approximately 1.2 by volume. The undissolved dimethylsulfoxide is recycled into the first unit, while the mixture of aromatic extract and light petrol with an improved octane number (95) is collected, washed in such a way that it substantially contains no dimethylsulfoxide and is introduced into the petrol storage pool.

In order to illustrate the interest of the process according to the invention and facilitate the comparison of the results according to the prior art and those of the invention, there is a constant production of petrol, kerosene and diesel oil. The results are given in Table II.

In case A, the process is conducted in accordance with the prior art, i.e. where in conventional manner a petrol is produced from all the light and medium petrol fractions and part of the heavy fraction, the other part of the heavy fraction supplying the kerosene or motor diesel oil storage pool. In case B according to the invention, there is neither hydrotreatment nor reforming.

According to the invention (case B), a petrol storage pool is supplied by the light petrol fraction and the extract part (EL1) of the heavy petrol fraction leaving the second extraction unit (46% of the heavy petrol fraction, i.e. 7% of the charge), as well as the medium petrol fraction. Finally, a petrol quantity is obtained (37%) of octane number 93, which can be compared with the same quantity of petrol obtained according to the prior art (FIG. 7 representing the same added heavy petrol quantity), i.e. 37% and of octane number 90.

The remainder of the heavy petrol, i.e. the refined product enriched with non-aromatic hydrocarbons (ELR = 8%) is introduced either into the kerosene pool, or into the diesel oil pool and there are found to be improved fuel quantities compared with case A representing the prior art for the same production level (addition of the heavy petrol compliment, i.e. 8%, to the kerosene or diesel oil pool).

Example 2

Example 2 is performed under the same conditions as example 1 using the process of the invention (case D).

However, two performance modes are determined, one for winter and the other for summer.

For summer, the diesel oil pool is supplied by the L.C.O. fraction, whereas the petrol pool is supplied by the light petrol fraction serving as a second extraction solvent, the aromatic hydrocarbon-enriched extract (EL1) according to the process of the invention, the medium petrol and the refined product (ELR) of the heavy petrol. However, unlike in example 1, instead of supplying the kerosene or diesel oil pool, the refined product is mixed with the medium petrol fraction. This refined product contains approximately 30 ppm of nitrogen. The mixture formed, following washing for removing dimethylsulfoxide traces, undergoes a hydrotreatment and then reforming under the conditions described in Table III.

However, for winter, the petrol pool is supplied by the light petrol fraction, the extract according to the invention and the medium petrol fraction subject to the aforementioned hydrotreatment and reforming, whereas the diesel oil pool is supplied by the L.C.O. fraction and the refined product obtained according to the invention.

TABLE III

| Parameters | Hydrotreatment | Reforming |
|---|---|---|
| Temperature | 330° C. | 500° C. |
| Pressure | 25 bar | 6 bar |
| Space velocity | 5 | 2 |
| $H_2$/charge | 50 vol/vol | 4 mole/mole |
| Catalyst | $Al_2O_3$ + (Co—Mo) (procatalysis) | $Al_2O_3$ + (Pt + Sn) (Procatalysis) |

For comparison purposes, supply takes place in a conventional manner for winter (case C) of the diesel oil pool with the L.C.O. fraction and part of the heavy petrol (the same quantity as in the invention), while the petrol pool is supplied by the light petrol fraction, the medium petrol fraction, which has undergone the hydrotreatment and reforming processes substantially under the same conditions as described hereinbefore, as well as the complimentary part of the heavy petrol. However, for summer, the petrol pool is supplied by the light petrol fraction, the medium petrol fraction which has undergone the hydrotreatment and reforming processes as hereinbefore and the heavy petrol fraction. The results given in Table IV demonstrate that there is an improvement in the quality of the products obtained when operating according to the process of the invention.

TABLE II

| | A Prior Art | | | | B Invention | | | |
|---|---|---|---|---|---|---|---|---|
| | % by weight | RON | Smoke point | Cetane number | % by weight | RON | Smoke point | Cetane number |
| $E_l$ | 15 | 95 | | | 15 | 95 | | |
| $E_m$ | 15 | 89 | | | 15 | 89 | | |
| $E_{Ll}$ | 7 | 82 | | | 7* | 95 | | |
| Total petrol | 37 | 90 | | | 37 | 93 | | |
| Kerosene | 8 | | 12 | | 8** | | 25 | |
| L.C.O. | 25 | | | 25 | 25 | | | 25 |
| $E_L$ | 8 | | | 15 | 8** | | | 28 |
| Total diesel oil | 33 | | | 22.6 | 33 | | | 25 |

*extracted fraction $E_{Ll}$ from $E_L$
**refined product $E_{LR}$ from $E_L$

TABLE IV

| | C Prior Art | | | | | | D Invention | | | | | |
|---|---|---|---|---|---|---|---|---|---|---|---|---|
| | SUMMER | | | WINTER | | | SUMMER | | | WINTER | | |
| | % by weight | RON | Cetane | % by weight | RON | Cetane | % by weight | RON | Cetane | % by weight | RON | Cetane |
| $E_l$ | 15 | 95 | | 15 | 95 | | 15 | 95 | | 15 | 95 | |
| $E_m$ | 14 | 100 | | 14 | 100 | | 14 | 100 | | 14 | 100 | |
| $E_L$ | 15 | 82 | | 7 | 82 | | 7* | 100 | | | | |
| | | | | | | | 8** | 95 | | 7* | 95 | |
| Total petrol | 44 | 92 | | 36 | 94 | | 44 | 97 | | 36 | 97 | |
| L.C.O. | 25 | | 25 | 25 | | 25 | 25 | | 25 | 25 | 25 | |
| $E_L$ | | | | 8 | | 15 | | | | 8* | 28 | |
| Total diesel oil | 25 | | 25 | 33 | | 22 | 25 | | 25 | 33 | 25 | |

*extracted fraction EL1 from EL
**refined product ELR from EL

We claim:

1. A process for the fractionation and extraction of a hydrocarbon charge with a final boiling point of at least 220° C. to obtain a petrol and a kerosene comprising:

(a) fractionating said charge under fractionation conditions to produce at least three fractions:

(1) a light petrol fraction with a boiling point between approximately 25° and approximately 80° C. and containing an aromatic hydrocarbon content approximately less than 10% by weight of the light petrol fraction, (2) a medium petrol fraction with a boiling point between approximately 80° C. and at the most approximately 150° C. and having a nitrogen content below approximately 50 ppm, (3) a heavy petrol fraction with a boiling point at the most equal to 220° C. and having an aromatic hydrocarbon content between 25 and 75% by weight of the heavy petrol fraction, (b) extracting most of the aromatic hydrocarbons from said heavy petrol fraction by a first solvent for the aromatic hydrocarbons under extraction conditions in a first extraction zone, the volume ratio of said first solvent to the heavy petrol fraction being between 1 and 3, thereby producing a dearomatized refined product and an extract containing said first solvent and said aromatic hydrocarbons, (c) extracting said extract containing said first solvent and said aromatic hydrocarbons by a second auxiliary solvent under extraction conditions in a second extraction zone, producing an extract comprising said second auxiliary solvent, said first solvent being recycled to stage (b), the volume ratio of the auxiliary solvent to said extract containing said first solvent and said aromatic hydrocarbons being between 0.5 and 2, wherein said second auxiliary solvent is the light petrol fraction (approximately 25° C.–approximately 80° C.), and (d) collecting at least part of the dearomatized refined product of stage (b), so as to obtain a kerosene with an improved smoke point.

2. A process according to claim 1, wherein the hydrocarbon charge is at least one effluent from a catalytic cracking, thermal cracking, or catalytic hydrocracking process, or at least one crude petroleum charge or a distillate which has not undergone such a process.

3. A process according to claim 1, wherein the hydrocarbon charge results from a cracking process performed in the presence of a cracking catalyst under cracking conditions prior to said fractionation.

4. A process according to claim 1, wherein said medium petrol fraction of stage (a) contains approximately 5 to 50 ppm of nitrogen and is hydrotreated in a hydrotreatment zone under hydrotreatment conditions such that the nitrogen quantity, after hydrotreatment, is below 1 ppm and wherein the collected hydrotreatment effluent undergoes catalytic reforming in the presence of hydrogen in a reforming zone under reforming conditions, in such a way as to obtain a medium petrol fraction with an improved octane number.

5. A process according to claim 1, wherein at least part of the refined product of (b) is combined with diesel motor fuel, so as to obtain a diesel motor fuel with an improved cetane number.

6. A process according to claim 4, wherein at least part of the refined product of (b) is mixed with said medium petrol fraction of (a) in a proportion such that the nitrogen quantity of the thus-obtained mixture remains below 50 ppm and said mixture undergoes said hydrotreatment and said reforming, followed by the collection of the reformed petrol which is mixed with said extract of (c).

7. A process according to claim 1, wherein the light petrol fraction (25° C.–80° C.) contains 0.1 to 5% by weight of aromatic hydrocarbons.

8. A process according to claim 1, wherein the heavy petrol fraction contains less than 15% by weight of dicyclic hydrocarbons having at least one aromatic ring.

9. A process according to claim 1, wherein said first solvent is dimethylsulfoxide, polyethylene glycol or dimethylformamide.

10. A process according to claim 9, wherein said first solvent contains 1 to 10% of water.

11. A process according to claim 8, wherein the heavy petrol fraction contains 1–10% by weight of dicyclic hydrocarbons with at least one aromatic ring.

12. A process according to claim 1, wherein the hydrocarbon charge has boiling points of 25°–350° C.

13. In a process for the production of gasoline from a hydrocarbon charge with a final boiling point of at least 220° C., wherein said charge is fractionated into at least a light, a heavy, and a middle fraction and said heavy fraction is extracted with a solvent, the improvement wherein said extraction is conducted in two stages, and the solvent in the second stage is the light fraction separated from the charge.

* * * * *